United States Patent [19]

Koulouras

[11] 4,455,752

[45] Jun. 26, 1984

[54] CHILDREN'S TOYS AND PARTICULARLY SAND TOYS

[76] Inventor: Katherine Koulouras, 24000 Lahser Rd., Southfield, Mich. 48034

[21] Appl. No.: 407,179

[22] Filed: Aug. 11, 1982

[51] Int. Cl.[3] ..... B43L 11/04; A63H 33/00

[52] U.S. Cl. ..... 33/41 D; 446/70

[58] Field of Search ..... 33/1 H, 41 D, 44; 15/235.6; 46/1 R, 91; 272/1 A; 434/81, 82

[56] References Cited

U.S. PATENT DOCUMENTS

| | | | |
|---|---|---|---|
| 1,894,155 | 1/1933 | Burton | 33/44 |
| 2,088,161 | 7/1937 | Chambers | 33/41 D |
| 2,395,186 | 2/1946 | Jones | 15/235.6 |
| 2,561,521 | 7/1951 | Lent | 15/235.6 |
| 3,166,776 | 1/1965 | Selck | 15/235.6 |

FOREIGN PATENT DOCUMENTS

| | | | |
|---|---|---|---|
| 50971 | 2/1910 | Switzerland | 33/41 D |

*Primary Examiner*—Richard R. Stearns
*Attorney, Agent, or Firm*—Barnes, Kisselle, Raisch, Choate, Whittemore & Hulbert

[57] ABSTRACT

A sand toy comprising a generally planar body having at least one edge with a plurality of serrations along the edge, spaced side edges and finger engaging holes whereby the sand toy can be grasped along the side edges with the fingers engaging the openings in order to move the sand toy to bring the serrations into contact with sand and the like.

6 Claims, 4 Drawing Figures

FIG.1
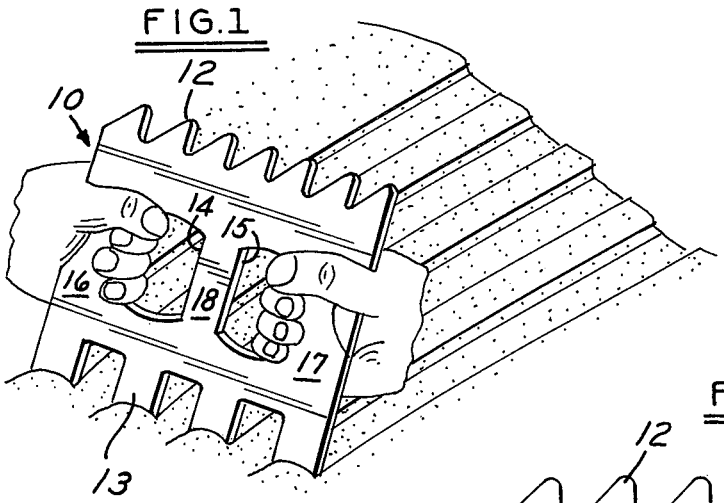
FIG.2
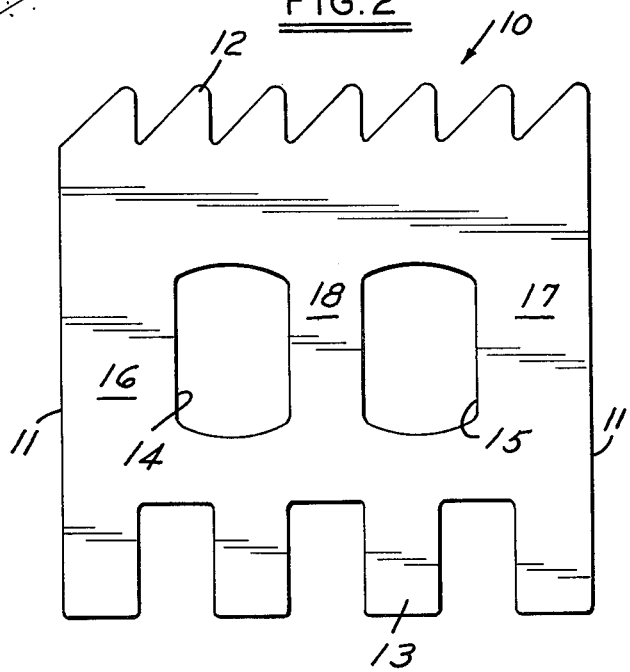
FIG.3
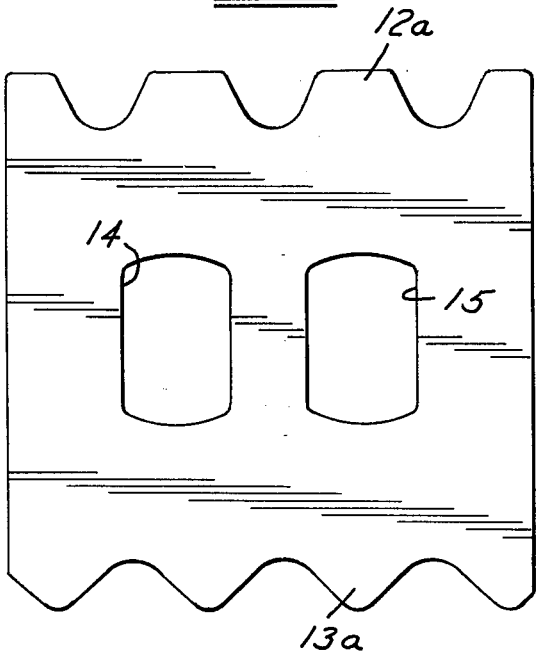
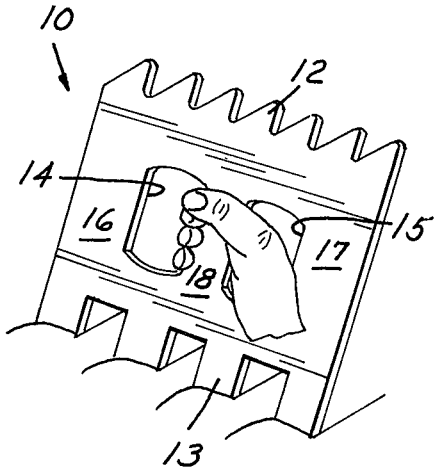
FIG.4

CHILDREN'S TOYS AND PARTICULARLY SAND TOYS

This invention relates to children's toys and particularly sand toys.

BACKGROUND AND SUMMARY OF THE INVENTION

In the case and education of children and particularly pre-school children, it is common to provide sand toys to not only occupy the time of the children and create recreation but also to improve motor coordination, creativity, movement and the like.

One common type of sand toy that has been used is a generally rectangular piece of uniformly thick Masonite which has one edge formed with serrations of various configurations which permit movement of the toy along a pile of sand or the like to create designs. Such a toy can not be used with moist or wet sand and offers limited challenge because of the artistic abilities of the child.

It has been found that such a toy is effective but creates some difficulty in the manipulation thereof by small children.

Accordingly, among the objectives of the present invention are to provide a sand toy which is more easily utilized by children, which is more attractive to children; which functions to increase motor coordination, creativity, movement, language enrichment; and which is safe.

In accordance with the invention, the sand toy comprises a generally planar body, at least one edge with a plurality of serrations along said edge, spaced side edges, and finger engaging holes whereby the sand toy can be grasped along the side edges with the fingers engaging the openings in order to move the sand toy to bring the serrations into contact with sand and the like.

DESCRIPTION OF THE DRAWINGS

FIG. 1 is a perspective view showing the sand toy embodying the invention being used.

FIG. 2 is a plan view of the sand toy.

FIG. 3 is a plan view of a modified form of the sand toy.

FIG. 4 is a perspective view showing a different manner of use of the toy.

DESCRIPTION

Referring to FIG. 2, the sand toy 10 comprises a body of plastic which is of uniform thickness. The plastic may comprise various types of plastic such as polycarbonate or acrylic and is preferably colored and translucent or transparent to make it more attractive and encourage the creativity of the child by the effect produced due to the translucency and transparency. In a preferred form, the body is of flat solid stock having a thickness of about 3/16 of an inch.

As shown in FIG. 2, the body 10 includes spaced side edges 11 and top and bottom edges formed respectively with serrations 12, 13, the serrations 12 being offset triangles and the serrations 13 being generally rectangular fingers. The toy further includes spaced finger receiving openings 14, 15 which are elongated in a direction parallel to the edges 11 and separated from the edges 11 by edge portions 16, 17 and an intermediate portion 18. The portion 18 is of less width than the portions 16, 17.

Thus, the body 10 can be grasped by two hands as shown in FIG. 1 with the fingers extending partially into the openings and grasping the portions 16, 17. Alternatively, the body can be manipulated by grasping portion 18, as shown in FIG. 4. The sand toy is utilized by moving the serrations 12 or 13 along the sand to manipulate the sand. The width of portion 18 is preferably about one inch and the width of portions 16, 17 is preferably about 1½ inches. The openings 14, 15 preferably have a width of 1½ inch and a length of 2½ inch extending generally parallel to the side edges 11.

In the form shown in FIG. 3, serrations **12*a* and 13*a* are of different configurations, the serrations 12*a* comprising recesses connected by flat portions and the serrations 13*a*** being generally V-shaped.

The spontaneous behaviors observed and recorded with children ranging between 2¼ and 6 years of age utilizing the sand toy have been analyzed and are summarized as follows:

| | |
|---|---|
| Grasp<br>(Fine Motor Coordination) | 1. The toy permits the children to exercise a variety of grasps. Those observed included:<br>a. Two hands at the top-design side or straight edge.<br>b. One hand grip using gripper in adult fashion.<br>c. One hand grip with fingers through one hole and palm holding flat edge.<br>d. Two hand grip with one hand as in c. above and other hand used to support toy on opposite side.<br>e. Two hand grip with palms against design and fingers through hold.<br>(Given children used several grips depending on the ways in which they used the toy.) |
| Functions<br>(Creativity, problem solving) | 2. The following functions were observed:<br>a. Making grooved designs in the sand.<br>b. Moving the toy flatly across sand to make "roadway" indentation.<br>c. Using toy as a mold, i.e. piling sand and pressing it.<br>d. Using toy as a brace - standing it in sand and piling sand around it.<br>e. Using toy as a drop-through, placing it over a container and dropping sand through |

-continued

| | |
|---|---|
| | the holes.<br>f. Using toy as shovel - scooping sand with flat or grooved edge and transfering from one place to another.<br>g. Using toy as a scraper - to smooth sand.<br>(Designing, Molding, Building, Scraping and Shoveling in the sand.) |
| Position options (Movement) | 3. The children used the toy in various positions. The most popular were:<br>a. Standing up and bending at the waist, using the entire sandbox area located at ground level as the space in which to play.<br>b. On knees - using the space as far as the arms can stretch.<br>c. Sitting down - using the space directly in front.<br>d. Stooping - using the space directly in front and in semi circular motions. |
| Language Enrichment | 4. The toy can be used to stimulate vocabulary development.<br>a. One child used the word "design" after modeling.<br>b. Children used terms such as "groove, rectangle, scrape, dig, shovel, lift, balance, weigh, etc." in response to modeling.<br>c. The language enrichment offered social exchange and interaction between children. |

Conclusions:

1. Design seams adequate for providing children various gripping options to meet developmental needs of children.
2. Two edges with straight design enhance grip options as well as use options.
3. Children demonstrated sustained spontaneous interest. Younger children demonstrated short interest span but might return to toy for repeated short intervals. Older children sustained interested and varied use of toy spontaneously.
4. The toy can be used for a variety of teaching purposes.
5. The toy provides for both individual play experiences as well as social exchange with other children. Two pieces will be part of one set, each with different design patterns on two sides.
6. Safety measures have been primary in design of this toy. It is imperative that the material used to create this toy be of safe composition. The design and structure of this toy be such that it will not cause injury or harm to children.
7. The toy should be made of durable material and manageable by children of per school age or older.

I claim:

1. A sand toy comprising a generally planar body, said body having at least one edge with a plurality of serrations along said edge, said body having spaced side edges, said body having spaced finger engaging openings, the shape of and distance between the openings being such that the sand toy can be grasped both with the fingers engaging the openings and the thumb spanning the portion of the body between said openings, or alternatively, with the fingers of each hand engaging a respective opening and the associated thumb spanning the portion of the body between the respective opening and the respective side edge in order to move the sand toy to bring the serrations into contact with sand and the like.

2. The sand toy set forth in claim 1 wherein said openings are elongated in a direction generally parallel to the side edges.

3. The sand toy set forth in claim 1 wherein said body includes a second edge having serrations thereon.

4. The sand toy set forth in claim 1 wherein said body is made of generally uniformly thick plastic material.

5. The sand toy set forth in claim 4 wherein said body is made of translucent material.

6. The sand toy set forth in claim 1 wherein the distance between said openings is less than the distance between each said side edge and the opening adjacent thereto.

* * * * *